United States Patent [19]

Carrieri

[11] 3,955,396

[45] May 11, 1976

[54] PRESS OVERLOAD PROTECTION SYSTEM

[75] Inventor: Louis F. Carrieri, LaGrange, Ill.

[73] Assignee: Gulf & Western Manufacturing Company, Southfield, Mich.

[22] Filed: Oct. 11, 1974

[21] Appl. No.: 514,107

[52] U.S. Cl. ..... 72/432; 100/53; 137/115

[51] Int. Cl.[2] ..... B21D 55/00

[58] Field of Search ..... 72/432, 431, 453, 351; 137/115; 100/53, 269

[56] References Cited

UNITED STATES PATENTS

| | | | |
|---|---|---|---|
| 1,560,135 | 11/1925 | Bell | 72/432 |
| 1,808,606 | 6/1931 | Pels | 100/53 |
| 2,891,497 | 6/1932 | Treer | 72/432 |
| 2,936,055 | 5/1960 | Kassnel | 72/432 |
| 3,481,171 | 12/1969 | Alexander | 72/432 |
| 3,583,201 | 6/1971 | Topaz | 100/53 |
| 3,693,506 | 9/1972 | McMillen | 137/115 |

*Primary Examiner*—C. W. Lanham
*Assistant Examiner*—Gene P. Crosby
*Attorney, Agent, or Firm*—Meyer, Tilberry & Body

[57] ABSTRACT

A hydraulic pressure actuated fluid flow control circuit is connected to a press actuated overload cylinder and piston assembly. The fluid flow circuit including the cylinder and piston assembly are charged to a given pressure, and upon an overload on the press the cylinder and piston assembly operate to increase fluid pressure in the circuit. The circuit includes a high response fluid pressure actuated relief valve operable in response to such increase in system pressure to dump system fluid in a manner whereby the entire system pressure is released so as to accelerate opening of the relief valve and dumping of the system fluid.

28 Claims, 8 Drawing Figures

FIG. 3
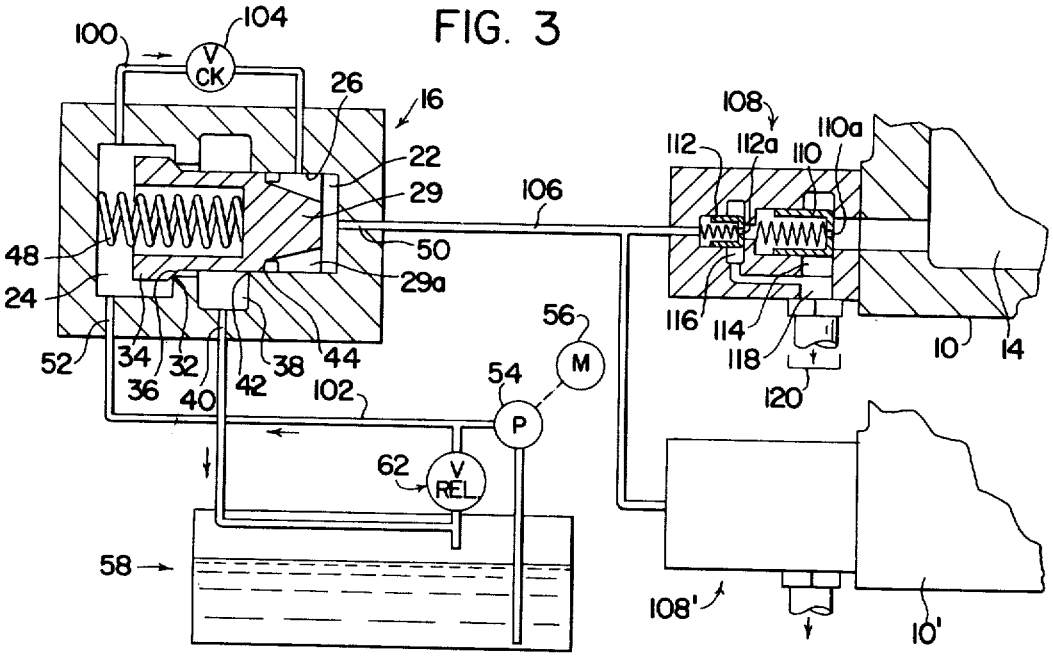
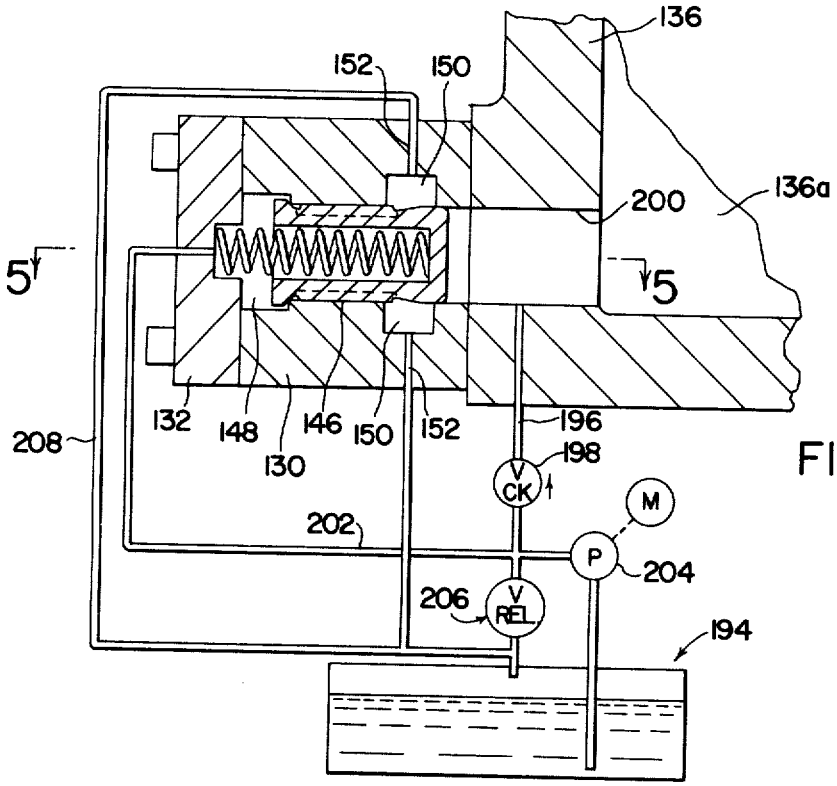
FIG. 4

PRESS OVERLOAD PROTECTION SYSTEM

The present invention relates to the art of hydraulic fluid flow systems and, more particularly, to a hydraulic pressure overload protection circuit for such systems.

The present invention finds particular utility in conjunction with protecting a mechanical press from damage due to an overload during operation thereof and, accordingly, will be described in detail in connection with such use. However, it will be appreciated that the hydraulic pressure overload relief capability achieved in accordance with the present invention has application in hydraulic fluid flow circuits other than those associated with a mechanical press overload protection system.

In the operation of mechanical presses, it is not an unusual occurrence for a press to be subjected to an overload condition. For example, a press employed to form metal blanks of a given thickness may be subjected to an overload condition if more than one of the blanks is accidentally introduced into the press or if a blank of a thickness greater than the given thickness is introduced into the press. As a further example, an overload condition may occur if the press is not properly adjusted to the particular operation to be performed, or if the tools or the like are inadvertently left in the press. In the absence of an overload relief system, costly damage can occur to the press. In this respect, for example, the press tie rods can be overstressed, or the press dies can be damaged. Any such damage of course results in down time for the press and, additionally, the expense of the necessary repair work required by such damage.

To avoid or minimize the serious consequences of overloading a press, various types of overload devices have been designed to relieve the overload condition. Often these overload devices are incorporated in the bed of the press and generally, are of a hydraulic nature and include a hydraulic cylinder and piston assembly defining a hydraulic fluid receiving overload chamber therebetween. Such an overload device further includes a source of hydraulic fluid which is introduced into the chamber under pressure, and an arrangement to vent the chamber in the event of an overload condition which increases the pressure of fluid in the chamber. Further, such a venting arrangement often includes a pressure responsive relief valve which is actuated when the fluid pressure in the chamber exceeds a certain level to dump system fluid including that in the cylinder to a tank or the like by which the fluid is returned to the fluid source for the system.

The present invention, in use in connection with presses, is of the latter character and includes a fluid pressure actuated relief or dump valve in the overload protection circuit. Fluid pressure responsive relief valves having a constant closing force such as a spring and other special valve arrangements heretofore employed in such press overload protection systems have several shortcomings. Among the major disadvantages is the fact that the response time of such valves and valve arrangements generally has been poor, operating in the region of 15 to 40 milliseconds to achieve full opening thereof and relief of fluid pressure therebehind. In presses encountering an overload at high slide velocity, such poor reaction time results in little or no protection for the press and, in any event, requires more than a desired amount of time to realize sufficient relief of fluid in the protection system to avoid the possibility of some damage. For example, if a press slide is moving at a velocity of 10 inches per second and meets an unyielding obstruction at that velocity, the force increase on components of the press would be at a rate of 100 times full press load per second, assuming the press has a full load strain of 1/10 inch and has no overload relief device. To protect such a press, the overload protection system should have a response time of about 2 milliseconds or less. It will be appreciated, therefore, that little or no protection is provided where reaction time is in the region of 15 to 40 milliseconds.

Arrangements heretofore used in connection with press overload protection systems have also included the use of a solenoid actuated valve to vent a relief valve and thereby release full system pressure in response to a signal from a pressure switch or transducer in the system. Such an arrangement necessarily requires both the transfer of a pressure signal and subsequent operation of the solenoid valve and, consequently, response time is undesirably high and generally is within the region of 15 to 30 milliseconds.

Another important consideration in connection with press overload protection systems of the foregoing character is minimizing pressure overshoot above the unloading or set point for the relief valve. By minimizing pressure overshoot, sinusiodal pressure fluctuations during the fluid dumping flow are advantageously minimized. Heretofore, relief valve arrangements in such a system are designed to have a high set point for unloading the system in an effort to reduce response time, and such a high set point results in increasing pressure overshoot above the desired maximum pressure of actuation as determined by the relief valve setting.

Relief valves employed with previous press overload protection systems and designed in an effort to reduce response time are undesirably large valve structures which are both costly to produce and maintain and which experience sealing problems in the hydraulic system. Moreover, different valve designs and/or sizes may be required in systems associated with different size presses or different press slide velocities. Accordingly, there is a lack of versatility in press overload protection systems heretofore available.

In accorcance with the present invention, a press overload protection system is provided by which the problems heretofore encountered in such systems, including those specifically enumerated hereinabove, are overcome or minimized. In this respect, the overload protection system in accordance with the present invention minimizes response time for the relief valve of the system, whereby system fluid is rapidly exhausted to maximize protection for the press. Moreover, the protection system includes a relief valve which, when initially opened is thereafter rapidly accelerated in the opening direction to release system fluid.

More particularly, the relief valve in the system of the present invention is normally closed and has opposite ends exposed to fluid at a given system pressure. The valve is maintained closed primarily by system fluid at the given pressure acting against one side of the valve, and the pressure at the one side is maintained at the given level. An increase in fluid pressure in the system resulting from a press overload is transmitted to the other side of the valve and acts against the closing force. In response to a pressure increase indicative of press overload, the one end of the valve opens to release fluid at system pressure therebehind to exhaust, and the high pressure fluid acting against the opposite side of the valve accelerates movement of the valve in the opening direction and release of the high pressure fluid behind the other side to exhaust. Acceleration of the opening movement in this manner minimizes response time. Further, the use of fluid at system pressure as the primary closing force in the foregoing manner minimizes the set point pressure for the valve and accordingly minimizes pressure overshoot upon opening of the valve. Moreover, the use of fluid at system pressure for closing the valve and establishing a set point for valve opening advantageously enables the use of one size relief valve for a wide variety of press sizes and slide speeds.

It is accordingly an outstanding object of the present invention to provide an improved hydraulic type fluid pressure responsive overload protection system for presses.

Another object is the provision of a protection system of the foregoing character which minimizes response time in the event of a press overload to maximize press protection.

Yet another object is the provision of a system of the foregoing character including a relief valve having improved performance characteristics which minimize response time in the event of an overload on the press.

A further object is the provision of a system of the foregoing character in which system fluid at a given pressure provides the primary force for maintaining the relief valve closed, and in which the relief is responsive to a pressure in excess of the given pressure to release the holding fluid at system pressure and accelerate opening movement of the relief valve.

Yet a further object is the provision of a system of the foregoing character in which the relief valve is relatively small in comparison to relief valves heretofore employed in such systems, whereby the overall system is more compact structurally and is more economical to produce and maintain than such previous systems, and which is highly efficient in operation.

Still another object is the provision of a pressure responsive fluid flow control circuit including a fluid pressure actuated relief valve normally closed primarily by system fluid at a given pressure and wherein the closing fluid is released upon an increase in pressure in the system to substantially eliminate closing force and permit acceleration of the valve in the opening direction to exhaust system fluid at the increased pressure.

The foregoing objects, and others, will in part be obvious and in part will be pointed out more fully hereinafter in conjunction with the description of preferred embodiments illustrated in the accompanying drawings in which:

FIG. 3 is a schematic illustration of another press overload protection system in accordance with the present invention;

FIG. 4 is a schematic illustration of a press overload protection system in accordance with the present invention and showing a preferred relief valve structure in the system;

Figure 1:
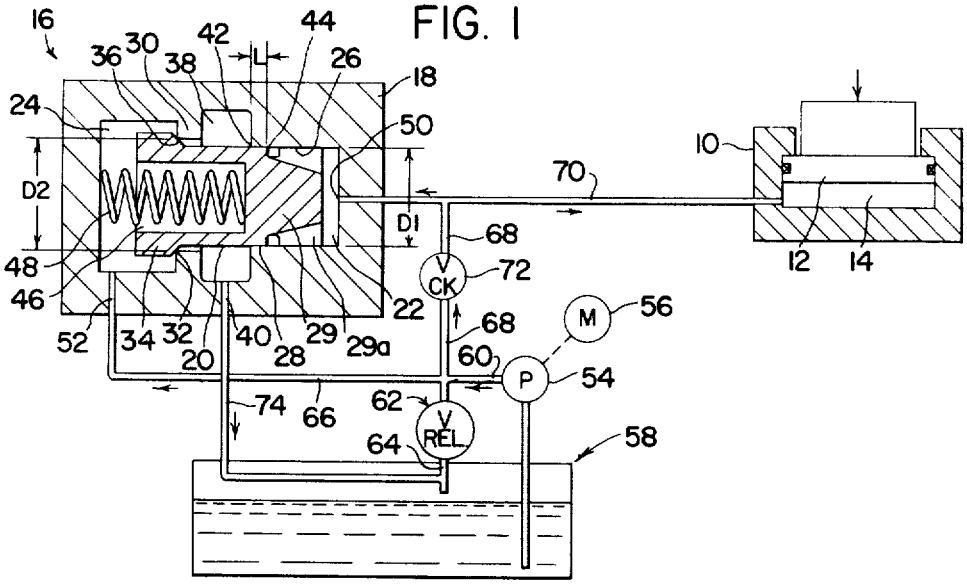
FIG. 1 is a schematic illustration of a press overload protection system in accordance with the present invention and including a high response relief valve.

Referring now in greater detail to the drawings wherein the showings are for the purpose of illustrating preferred embodiments of the invention only and not for the purpose of limiting the invention, FIG. 1 shows a press overload protection system including an overload cylinder 10 and an associated overload piston 12 which, in a well known manner, are operatively mounted on a press so as to be actuated in response to an overload on the press. Cylinder 10 and piston 12 cooperatively define a fluid receiving chamber 14 and, in response to press overload, piston 12 is displaced relative to cylinder 10 to reduce the volume of chamber 14 and thus pressurize the fluid therein.

The overload protection system further includes a fluid pressure actuated relief or unloading valve 16 comprised of a valve housing 18 having a cylindrical spool valve component 20 reciprocably supported therein. Housing 18 is provided with a first fluid receiving chamber 22 at one end thereof and a second fluid receiving chamber 24 coaxial with and axially spaced from chamber 22. Chamber 22 includes a cylindrical wall 26 slidably receiving the corresponding end of spool 20. The latter end of the spool includes a cylindrical peripheral surface 28 having a close fit with cylindrical wall 26 to seal against the leakage of fluid therebetween. Cylindrical wall 26 and spool surface 28 cooperate to define a valve seat and valve element for opening and closing chamber 22, as set forth more fully hereinafter. Chamber 24 includes a cylindrical radially inwardly extending wall 30 having a cylindrical edge 32, and the corresponding end of spool 20 is provided with a radially outwardly projecting flange 34 provided with a chamfered surface 36 adapted to engage edge 32. Edge 32 and surface 36 cooperably define a valve seat and valve element surface for opening and closing chamber 24, as set forth more fully hereinafter. Body 18 is provided with a discharge passage 38 axially between chambers 22 and 24 and extending about spool 20, and passage 38 is provided with an outlet port 40.

The end of spool 20 disposed in chamber 22 behind spool surface 28 includes a generally frusto-conical portion 29 having a major cross-sectional dimension less than the diameter of surface 28. A plurality of circumferentially narrow guide members **29*a* extend radially from portion 29 and slidably engage chamber surface 26 to support and guide reciprocating movement of spool 20** in the valve housing.

Discharge passage 28 intersects with cylindrical wall 26 of chamber 22 to define a cylindrical edge 42. When the relief valve is closed as shown in FIG. 1, cylindrical surface 28 of the spool has an axial length L between edge 42 and spool edge 44 which defines the extent of axial movement of the spool required to open chamber 22 with respect to discharge passage 38.

Spool 20 is provided with an axial recess 46 opening thereinto from the end of the spool disposed in chamber 24. A biasing spring 48 has its inner end disposed in recess 46 and its outer end in abutting engagement with a wall of chamber 24 so as to bias spool 20 in the direction to close the relief valve. Housing 18 further includes an inlet passage 50 opening into chamber 22 and inlet passage 52 opening into chamber 24.

The overload protection system further includes a pump 54 driven by a suitable motor 56 to deliver hydraulic fluid to the system from a suitable source 58 and to charge the system to a predetermined given pressure. In the embodiment shown, the outlet of pump 54 is connected to the system through a feed line 60 and a relief valve assembly 62 which is operable under normal conditions to maintain the system at the given pressure. In this respect, in response to an increase in system pressure, other than that caused by a press overload, relief valve 62 opens to discharge system fluid to a line 64 from which the fluid is returned to source 58.

Hydraulic fluid at the given system pressure is delivered to inlet passage 52 and chamber 24 of valve 16 through a flow line 66, and to inlet passage 50 and chamber 22 of the valve and pressure chamber 14 of the overload cylinder and piston assembly through a flow line 68 and a flow line 70 communicating with line 68. A one way check valve 72 is provided in line 68 between the point of communication of line 70 therewith and the point of communication of line 68 with pump line 60 and line 66. Accordingly, it will be appreciated that fluid at system pressure is free to flow past valve 72 in the direction toward valve chamber 22 and overload cylinder chamber 14 and that valve 72 prevents flow of system fluid from the latter chambers into valve chamber 24, relief valve 62 or pump 54.

In operation of the overload protection arrangement described above, pump 54 delivers hydraulic fluid at the predetermined system pressure to chambers 22 and 24 of valve 16 and to chamber 14 between cylinder 10 and piston 12. Accordingly, all three chambers normally contain system fluid at the given system pressure. Fluid at system pressure in chamber 24 together with the biasing force of spring 48 maintains relief valve 16 in the closed position thereof as shown in FIG. 1. Moreover, the end of spool 20 disposed in chamber 24 has an effective pressure receiving surface the diameter of which corresponds to the diameter of seat edge 32 which is designated D2 in FIG. 1. Further the end of the spool disposed in chamber 22 has a pressure receiving surface the diameter of which corresponds to the diameter of cylindrical wall 26 of the chamber as designated D1 in FIG. 1. Preferably, diameter D2 is greater than D1. Accordingly, fluid in chamber 24 at a given system pressure exerts a greater biasing force to close the valve than the biasing force of the fluid at system pressure in chamber 22. This enables minimizing the closing force of spring 48 on the spool to an amount just sufficient to close the valve in the absence of fluid under pressure in chambers 22 and 24.

In the event of an overload on the press, piston 12 is displaced so as to reduce the volume of chamber 14 and this pressurizes the fluid in the system between chambers 14 and 22 through line 70 and that portion of line 68 between line 70 and check valve 72. Accordingly, fluid in this portion of the system is now at a pressure in excess of the given system pressure, and valve 72 prevents the transmission of fluid at the excess pressure to chamber 24 of valve 16. The increase in fluid pressure in chamber 22 of valve 16 displaces spool 20 in the direction to open chambers 22 and 24 with respect to discharge passage 38. In response to such movement, valve element surface 36 immediately disengages from valve seat edge 32 to open chamber 24 to discharge passage 38, whereby system fluid in chamber 24 and therebehind is immediately discharged from chamber 24 into discharge passage 38 and discharge flow line 74 which leads back to source 54.

The initial opening of chamber 24 to discharge passage 38 precedes movement of spool 20 the distance L required to open chamber 22 to the discharge passage. Accordingly, the pressure in chamber 22 is still at an excess pressure with respect to the given system pressure at the time chamber 24 initially opens. This condition provides for the excess pressure in chamber 22 upon initial opening of chamber 24 to accelerate displacement of spool 20 in the opening direction. In this respect, the closing force is minimized substantially to that of spring 48 by the immediate discharge of fluid from the chamber 24. When edge 44 of spool 20 passes chamber edge 42, chamber 22 is then open to discharge passage 38 to release the fluid column between the press and chamber 22. It will be appreciated that outlet port 40 and flow lines 70 and 74 are sufficiently large for fluid flow therethrough to be unobstructed during operation of the valve to dump system fluid.

Following opening of relief valve 16 in the foregoing manner and the release of system fluid, pump 54 is operable to recharge the system, and system fluid in chamber 24 together with spring 48 return the relief valve to the closed position. It will be appreciated that suitable controls, not shown, can be employed to stop or otherwise control the press in response to the overload condition and to de-energize pump motor 56 until such time as the condition causing the overload is corrected.

Figure 2:
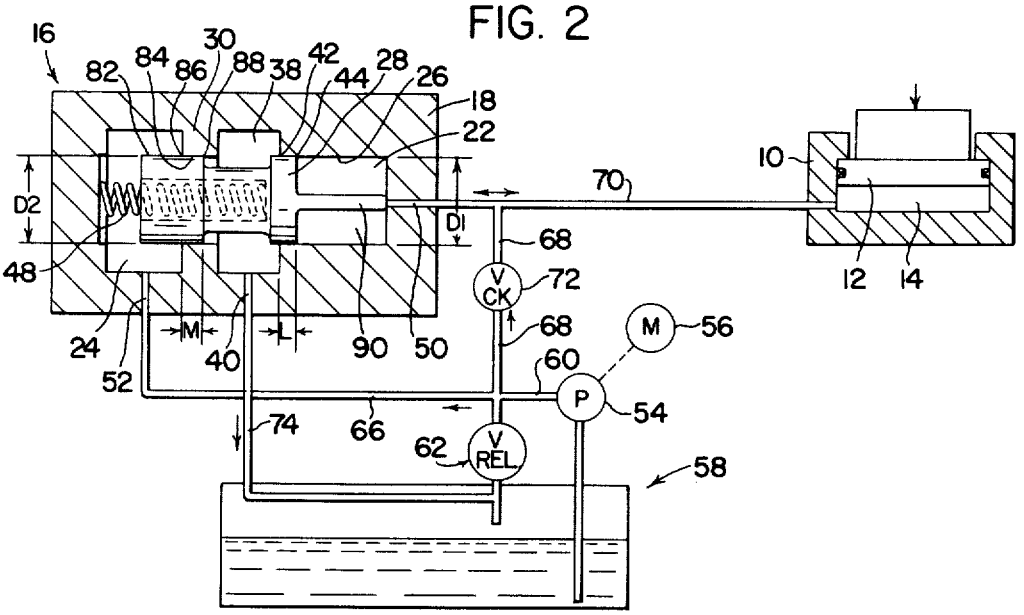
FIG. 2 is a schematic illustration of a press overload protection system in accordance with the present invention and including a modification of the relief valve shown in FIG. 1.

The overload protection system shown in FIG. 2 basically differs from that shown in FIG. 1 only in the construction of the spool element of the relief valve. Accordingly, like numerals are employed in FIG. 2 to designate components corresponding to those shown in FIG. 1. In FIG. 2, the valve spool 80 is structurally different from valve spool 20 shown in FIG. 1 primarily in that the end of the valve spool disposed in chamber 24 has a cylindrical outer surface 82 slidably engaging cylindrical inner surface 84 of wall 30. Further, surface 84 of wall 30 has a circular edge 86, and cylindrical surface 82 of the spool has a circular edge 88 axially spaced from edge 86 toward discharge chamber 38 when the valve is in the closed position as shown in FIG. 2.

The end of spool 80 disposed in chamber 22 includes a cylindrical outer surface 28 and a cylindrical edge 44 as in the embodiment shown in FIG. 1. In the embodiment of FIG. 2, however, the remaining portion of the end of the spool disposed in chamber 22 is defined by a plurality of circumferentially narrow radially extending guide members 90 having an axial extent providing for engagement thereof with the end wall of the chamber to limit movement of spool 80 in the closing direction. As in the embodiment of FIG. 1, the guide members support and guide reciprocating movement of the spool When the relief valve is in the closed position as shown in FIG. 2, spool edge 44 is axially spaced from edge 42 of the opening to discharge passage 38 a distance L, and spool edge 88 is axially spaced from edge 86 of wall 30 a distance M. The overlap represented by distances L and M prevent pressure loss to line 74 through discharge passage 38 and outlet port 40.

The ends of spool 80 in chambers 22 and 24 have corresponding pressure receiving faces the areas of which are determined by the corresponding diameters of the cylindrical surfaces 28 and 82 designated D1 and D2, respectively. Accordingly, the closing force on the spool element to maintain the relief valve closed can be provided either by valve spring 48 alone, for valves in which dimension D1 equals dimension D2, or by the valve spring together with system pressure acting on the difference in areas of the pressure receiving surfaces where the dimension D2 is greater than the dimension D1.

Valve response on operation of the system shown in FIG. 2 corresponds to that described hereinabove in connection with the embodiment of FIG. 1. In this respect, excess pressure in chamber 22 displaces spool 80 in the opening direction. When the spool edge 88 passes edge 86 of wall 30, chamber 24 opens to discharge passage 38 and the spool thereafter is accelerated in the opening direction by the fluid pressure in chamber 22. Due to the axial overlap by cylindrical surface 82 and surface 84 of wall 30, chamber 24 will not immediately open as in the embodiment of FIG. 1. Accordingly, response time may be slightly increased with the arrangement shown in FIG. 2, but in any event the release of fluid at system pressure from chamber 24 is immediately followed by acceleration of the spool due to the fluid in chamber 22 at a pressure exceeding the given system pressure. It is essential in accordance with the present invention that chamber 24 open either before or simultaneously with the opening of chamber 22. Accordingly, axial length M must be equal to or less than axial length L. It will be appreciated therefore that response time is reduced as dimension M diminishes relative to dimension L.

FIG. 3 shows another embodiment of a press overload protection system. Certain components of the system shown in FIG. 3 correspond to those of the system shown in FIG. 1, and like numerals appear in these Figures to designate corresponding components. In the embodiment of FIG. 3, hydraulic fluid from source 58 is delivered to the components of the system through relief valve 16 and a bypass line 100 between chambers 22 and 24. More particularly, fluid from source 58 is delivered to chamber 24 through line 102, thence to chamber 22 through bypass line 100 and check valve 104 therein, and thence to chamber 14 of the overload cylinder and piston device through a feed line 106 and a multiple stage poppet valve assembly 108. Check valve 104 permits the flow of fluid at system pressure in the direction from chamber 24 toward chamber 22 and prevents fluid flow in the opposite direction, whereby fluid in chamber 24 is maintained at system pressure as in the embodiment of FIG. 1 when a fluid pressure indicative of press overload is transmitted to relief valve 16.

Poppet valve assembly 108 is suitably mounted on overload cylinder 10 for communication with chamber 14 and includes primary and secondary spring biased valve elements 110 and 112, respectively. Valve elements 110 and 112 are normally closed and, in the embodiment shown, are provided with apertures **110*a* and 112*a* which permit flow of system fluid therethrough into chamber 14 such that the normal pressure of fluid in chamber 14 is the given pressure to which the system is charged by pump 54 and pressure controlling relief valve 62**.

Poppet valve elements 110 and 112 are associated with corresponding discharge chambers 114 and 116, and the latter discharge chambers communicate with a common discharge passage 118 leading to a discharge line 120 which may, for example, provide for fluid discharged thereinto to flow back to source 58. The poppet valve assembly operates as the discharge valve for fluid in chamber 14 and as a pressure amplifier for fluid in the system between chamber 22 and the poppet valve assembly. In this respect, an overload on the press which reduces the volume of chamber 14 pressurizes the fluid therein to a pressure in excess of the given system pressure, and valve elements 110 and 112 open to discharge fluid therebetween and fluid in chamber 14 to discharge passage 118 and line 120. Simultaneously, the displacement of valve elements 110 and 112 causes an increase in the pressure of fluid in line 106 and chamber 22 of relief valve 16. The increased pressure in chamber 22 actuates valve spool 20 in the manner described hereinabove in connection with the embodiment of FIG. 1 to achieve opening of chamber 24 to discharge passage 38 and thence acceleration of the spool in the opening direction to open chamber 22 to discharge passage 38.

It will be appreciated, therefore, that the pressure in chamber 22 and line 106 is quickly relieved to remove the fluid pressure closing bias on poppet valve elements 110 and 112, allowing the latter to fully open and remain open with minimum closing bias during the exhaust of fluid in chamber 14 to discharge line 120.

While a two stage poppet valve arrangement is shown in the embodiment of FIG. 3, the intended fluid discharge and fluid pressure amplification functions can be achieved with a single stage arrangement. The use of a poppet valve arrangement in the overload protection system also enables the system to operate with a pressure in overload device chamber 14 which is less than the given system pressure in relief valve chambers 22 and 24. In this respect, for example, aperture **110*a* in poppet valve element 110 can be eliminated to close off flow communication between chamber 14 and line 106, and chamber 14 can be charged through a source of supply independent of source 58 to a given pressure. Chambers 22 and 24 of relief valve 16 and line 106 are charged by pump 54 to a system pressure above that of the pressure in chamber 14. Upon an overload on the press the pressure in chamber 14 is sufficiently increased above the given level thereof and poppet valve elements 110 and 112 are displaced to open chamber 14 to discharge passage 118 and to increase the pressure of fluid in line 106 an chamber 22 to cause actuation of relief valve 16 in the manner hereinabove described. The opening of valve 16, again as described above, relieves the pressure in chamber 22 and line 106 thus permitting poppet valve elements 110 and 112 to fully open passage 118 to flow of fluid from chamber 14**.

As is well known in the press art, a given press may be provided with one, two or four overload devices. In FIG. 3, an additional overload device including a cylinder 10' is shown connected to line 106 through a poppet valve assembly 108'. The system is operable through relief valve 16 to dump fluid simultaneously from the two overload devices. More particularly, such plural overload devices are associated with the press so as to be individually responsive to a corresponding overload condition. For example, if the press includes two die sets, each overload device is associated with one die set. If an overload condition is encountered with respect to either die set, both overload devices must be actuated to achieve press protection. In the arrangement shown in FIG. 3, actuation of one poppet valve assembly and the consequent opening of valve 16 exhausts holding fluid from the second poppet valve assembly whereby the latter opens to dump fluid from the corresponding overload cylinder. While the plurality of overload devices and valve 16 are shown in FIG. 3 in association with poppet valve arrangements, it will be appreciated that valves 16 in the systems shown in FIGS. 1 and 2 are likewise operable in connection with dumping a plurality of overload device directly connected in fluid flow communication therewith.

In FIGS. 4–8 of the drawing there is shown a preferred structure for a relief valve according to the present invention. The preferred valve is shown generally in FIG. 4 in association with a press overload device and is shown in detail in FIGS. 5–8. Referring to FIGS. 4–8, the relief valve includes a housing comprised of a body member 130 and an end plate member 132. End plate member 132 is attached to body 130 by means of a plurality of threaded fasteners 134, and the valve housing is mountable on the overload cylinder 136 of a press by means of a plurality of bolts 138. The facial juncture between body member 130 and end plate member 132 is suitably sealed against fluid leakage therebetween such as by means of an O-ring seal 140, and the facial engagement between body member 130 and overload cylinder 136 is similarly sealed such as by means of an O-ring seal 142.

Body member 130 is provided with an axial bore therethrough including a cylindrical intermediate portion 144 which receives and slidably supports a reciprocable spool component 146 as described more fully hereinafter. The bore through body member 130 is radially enlarged at one end of intermediate portion 144 to define a cylindrical fluid receiving chamber 148 with end plate member 132. The bore is also radially enlarged at the other end of intermediate portion 144 to provide a discharge chamber 150 surrounding spool member 146, and diametrically opposed discharge ports 152 extend radially through body member 130 and open into discharge chamber 150. The juncture between cylindrical intermediate portion 144 of the bore and chamber 148 is chamfered to define an annular valve seat 154, and the juncture between intermediate portion 144 and discharge chamber 150 defines a cylindrical edge 156. The bore through body member 130 further includes a cylindrical portion 158 of uniform diameter opening into discharge chamber 150 from the end of the body member facing overload cylinder 136.

Spool member 146 is provided at one end with a radially outwardly extending valve element portion 160 which is disposed in chamber 148 and which is provided with a chamfered surface 162 adapted to matingly engage valve seat surface 154 to close member 148 with respect to discharge chamber 150. Further, spool member 146 is provided with an axial bore 164 opening thereinto from end face 166 of valve element portion 160, and end plate member 132 is provided with an axially extending bore 168 which is aligned with bore 164. A biasing spring 170 has its opposite ends disposed in bores 164 and 168 and serves to bias spool member 146 in the direction of closure. End plate member 132 is provided with a fluid inlet opening 172 through which system fluid is delivered to chamber 148.

Figure 5:
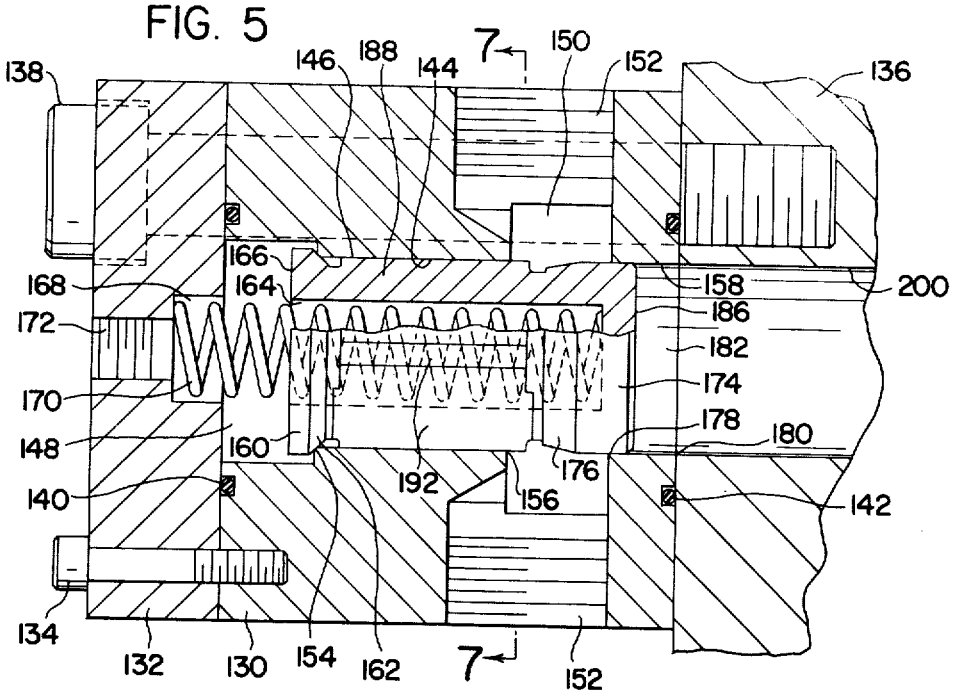
FIG. 5 is an enlarged sectional elevation view of the valve shown in FIG. 4 and showing the valve closed.

The other end of spool member 146 is provided with a valve head member including a cylindrical portion 174 and a tapered portion 176 at the axially inner end of the cylindrical portion. The outer diameter of cylindrical portion 174 provides for the latter portion to be received in cylindrical bore 158 for sliding and sealing engagement therewith. Cylindrical bore 158 intersects discharge chamber 150 along a cylindrical line 178 and intersects the outer end of body member 130 along a cylindrical line 180. The axial distance between lines 178 and 180 defines a chamber 182 which is closed with respect to discharge chamber 150 when the valve is in the closed position, as shown in FIGS. 4 and 5. Further, when the valve is closed as shown in the latter Figures, cylindrical portion 174 and cylindrical bore 158 have an axial overlap of about ⅛ inch between edge 178 and axially outer edge 184 of cylindrical portion 174. Cylindrical portion 174 includes a planar fluid pressure receiving face 186 against which fluid pressure in chamber 182 acts to bias spool member 146 to the left as seen in FIGS. 4 and 5.

In the embodiment disclosed, the intermediate portion 188 of spool member 146 is generally square in cross section, and the corners between adjacent sides thereof are rounded as at 190 to a radius corresponding to that of cylindrical wall 144. Accordingly, rounded corners 190 slidably engage cylindrical wall 144 to guide and slidably support reciprocating movement of spool member 146. Further, the areas between the flat side walls of spool portion 188 and cylindrical wall 144 define axial passages 192 for flow of fluid from chamber 148 to discharge passage 150.

As schematically shown in FIG. 4, hydraulic fluid from a source 194 is pumped to the fluid receiving chamber **136*a* in overload cylinder 136 through a feed line 196 having a check valve 198 therein. Chamber 182 of the relief valve communicates with chamber 136*a* through opening 200 thereinto, whereby fluid at system pressure fills valve chamber 182. Fluid at system pressure is delivered to valve chamber 148 through line 202, whereby spool member 146 is biased in the closing direction by fluid pressure in chamber 148 and the biasing force of spring 184**.

It will be appreciated that outer face 166 of the spool member together with the axial inner end of recess 164 therein define the pressure receiving face of the spool acted against by fluid under pressure in chamber 148 and that this face has an area determined by the diameter of the radially outermost edge of valve seat surface 154. Preferably, this area is greater than the area of face 186 at the opposite end of the spool and which defines a pressure receiving face acted upon by fluid pressure in chamber 182.

In operation of the valve shown in FIGS. 4–8, the system is charged to a given pressure through the operation of pump 204 and settable system relief valve 206, whereby the pressure in chamber 136a of overload cylinder 136 and chamber 182 of the relief valve is the same as the pressure of fluid in chamber 148 of the relief valve. This pressure relationship maintains the relief valve normally closed. Upon an overload on the press, the pressure of fluid in chamber 136a of cylinder 136 and thus in chamber 182 of the relief valve is increased, and check valve 198 prevents transmission of fluid at the increased pressure to valve chamber 148. Accordingly, spool 146 is displaced to the left from the position shown in FIG. 5 toward that shown in FIG. 6.

Figure 6:
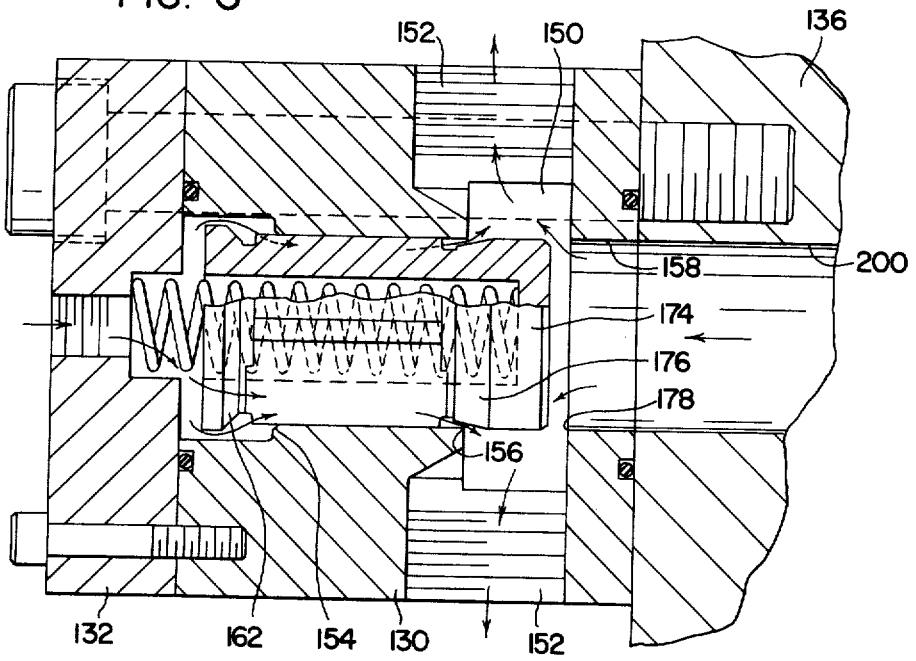
FIG. 6 is a view similar to FIG. 5 and showing the valve open.
Figure 8:
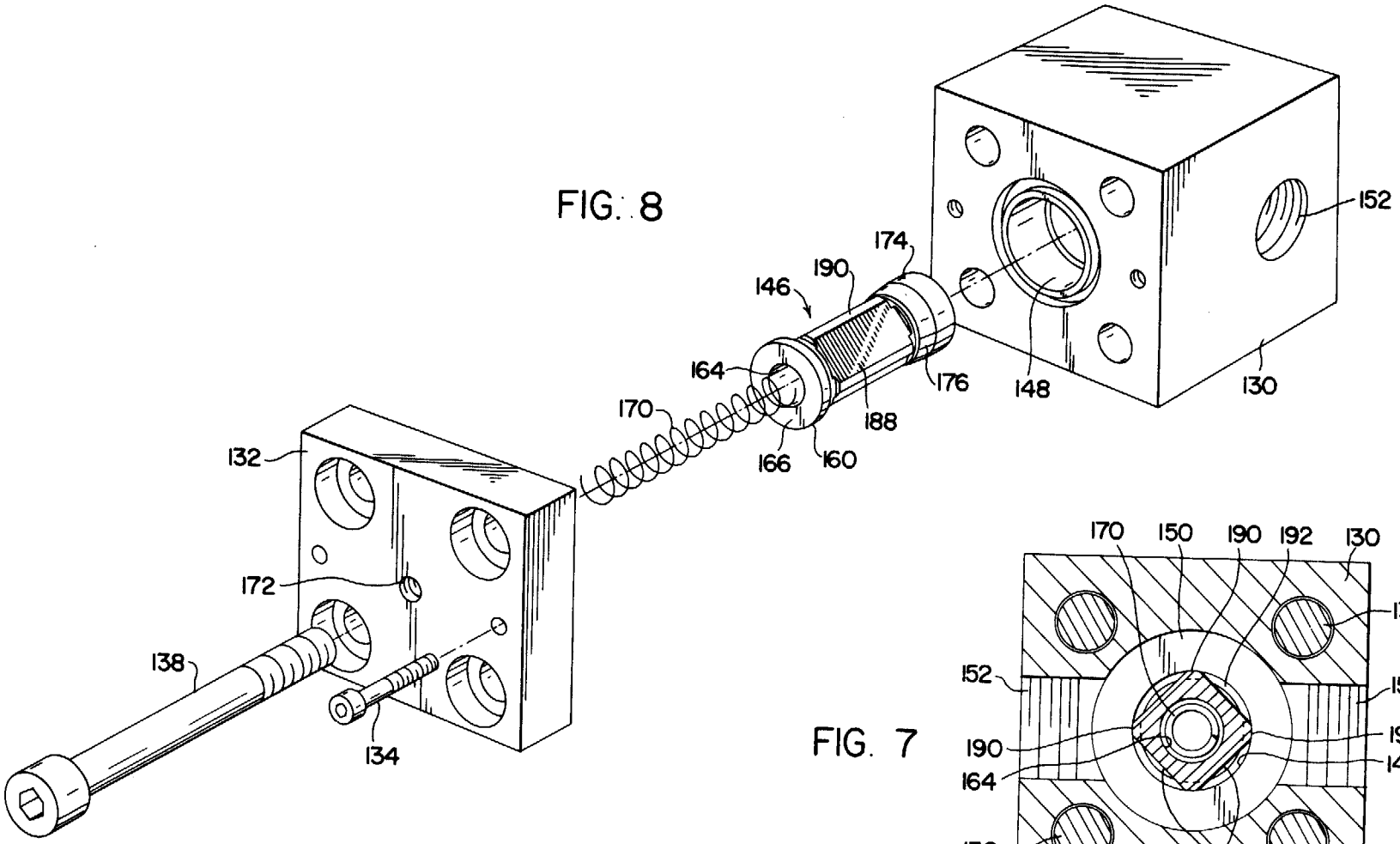
Figure 7:
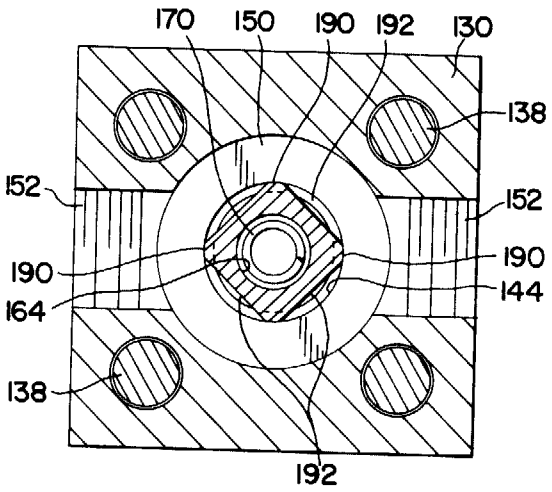
FIG. 7 is a cross-sectional view of the relief valve taken along line 7—7 in FIG. 5; and, FIG. 8 is an exploded perspective view of the components of the relief valve shown in FIGS. 4–7.

Upon movement of valve surface 162 from valve seat 154 fluid at system pressure is immediately discharged from valve chamber 148 to discharge passage 150, the flow of such discharge fluid being to the right along the intermediate portion of the spool member, as shown by arrows in FIG. 6. Just as soon as the latter discharge is initiated there is a pressure drop in chamber 148 which quickly reduces the closing bias against the spool member. Consequently, the fluid in valve chamber 182 at the pressure exceeding the given system pressure accelerates movement of spool member 146 in the opening direction, and the subsequent movement of edge 184 past edge 178 opens chamber 182 to discharge passage 150.

As mentioned hereinabove, movement of the spool member in the opening direction is accelerated by the exhaust of fluid at system pressure from chamber 148. As the spool then moves to the left toward the open position thereof shown in FIG. 6, tapered surface 176 of the spool member approaches edge 156 at the corresponding end of cylindrical passage 144. The flow of fluid to the right in FIG. 6 from chamber 148 through passages 192 along the spool impinges upon tapered surface 176 as the latter approaches edge 156. This decelerates opening movement of the spool member so as to minimize the possibility of damage to the spool member upon engagement of face 166 thereof with the inner surface of end plate member 132, and to minimize the noise of operation. The fluid discharged into passage 150 from chambers 148 and 182 is of course discharged therefrom through ports 152 for return to the fluid source such as by return lines 208 shown in FIG. 4.

By mounting the relief valve directly on the overload cylinder of the press advantage is taken of the face that fewer flow lines are required for the necessary transmission of hydraulic fluid to the overload protection system. It will be appreciated that mounting of the relief valve in the manner shown in FIG. 4 is applicable to the embodiment of FIGS. 1–3. It will be further appreciated that in the embodiment of FIGS. 4–8 relief valve 198 could be mounted on the valve housing and connected between chambers 148 and 182 by suitable openings through the housing and would, in such construction, provide for flow of fluid from chamber 148 to chamber 182 while preventing reverse flow between the chambers. The system would then be charged from the source through chamber 148, the latter check valve arrangement to chamber 182 and thence to fluid receiving chamber 136*a* in overload cylinder 136. It will be appreciated too that the check valve could be built into the relief valve to serve the intended function.

As many possible embodiments of the present invention can be made and as many possible modifications can be made in the embodiments herein illustrated and described, it is to be distinctly understood that the foregoing descriptive matter is to be interpreted merely as illustrative of the present invention and not as a limitation.

What is claimed is:

1. A force overload prevention system for a press comprising, relatively reciprocable piston and cylinder means on said press including a cylinder and a piston in said cylinder and defining a pressure chamber therewith, normally closed relief valve means, said valve means including a pair of separate fluid receiving chambers, fluid outlet means for said receiving chambers and reciprocable fluid pressure actuated valve element means, said valve element means being operable in response to fluid in said receiving chambers at the same given pressure to close said receiving chambers with respect to said outlet means and being operable in response to fluid in one of said receiving chambers at an actuating pressure exceeding said given pressure to open said receiving chambers with respect to said outlet means, a source of hydraulic fluid, hydraulic circuit means including means to deliver fluid from said source to said pressure chamber and said receiving chambers at said given pressure, said piston and cylinder being relatively displaced in response to an overload on said press to increase the fluid pressure in said pressure chamber to an actuating pressure, and said hydraulic circuit means including means between said pressure chamber and said one receiving chamber to increase the pressure in said one chamber to said actuating pressure and means to prevent flow of fluid in said circuit at said actuating pressure to the other of said receiving chambers, whereby said valve element means opens said receiving chambers to said outlet means and release of said fluid in said other chamber at said given pressure to said outlet means accelerates opening of said one chamber and dumping of said fluid in said circuit.

2. The overload prevention system according to claim 1, wherein said means to deliver fluid to said pressure chamber and receiving chambers includes flow line means between said receiving chambers and receiving fluid from said source, said means to prevent flow to said other chamber including one way valve means in said flow line means open to flow in the direction from said other chamber to said one chamber.

3. The overload prevention system according to claim 1, wherein said relief valve means includes spring means acting with said fluid in said other chamber to bias said valve element means in the closing direction.

4. The overload protection system according to claim 1, wherein said means between said pressure chamber and said one receiving chamber includes flow line means therebetween and fluid pressure responsive pressure relief and pressure transmitting second valve means in said flow line means, said second valve means being responsive to fluid in said pressure chamber at said actuating pressure to dump fluid from said pressure chamber and to amplify the pressure of fluid in said flow line means and thus said one receiving chamber to said actuating pressure.

5. The overload prevention system according to claim 1, wherein said relief valve means includes means cooperable with said valve element means to provide for said other chamber to open before said one chamber opens.

6. The overload prevention system according to claim 1, wherein said valve element means includes first and second valve members interconnected for movement in unison and associated respectively with said one and other chambers, said chambers including means defining valve seat means for the corresponding valve member, said fluid outlet means of said one chamber being a circular opening defining the valve seat means for said first valve member, said first valve member being a cylindrical head having mating sliding engagement with said circular opening when said one chamber is closed, said first valve member moving axially of said circular opening a given distance to open said first chamber, said second valve member engaging the seat means for said other chamber to close said other chamber and disengaging the last named seat means to open said other chamber, said disengagement occuring before said first valve member moves said given distance.

7. The overload prevention system according to claim 6, wherein said outlet means of said other chamber includes an annular valve seat coaxial with said circular opening, and said second valve member transversely engages said annular seat.

8. The overload prevention system according to claim 7, wherein each said first and second valve members has pressure receiving face means in the corresponding chamber when said chambers are closed, the face means of said second valve member having an effective area greater than that of the face means of said first valve member.

9. The overload prevention system according to claim 8, wherein said relief valve means includes spring means acting with said fluid in said other chamber to bias said valve element means in the closing direction.

10. The fluid flow system according to claim 6, wherein said outlet means of said other chamber is a circular opening defining the valve seat means of said second valve member, said second valve member being circular and having mating engagement with the last named circular opening when said other chamber is closed, said second valve member moving axially of said last named circular opening a second distance to open said other chamber, said second distance being less than said given distance.

11. The overload prevention system according to claim 10, wherein each said first and second valve members has pressure receiving face means in the corresponding chamber when said chambers are closed, the face means of said second valve member having an effective area greater than that of the face means of said first valve member.

12. The overload prevention system according to claim 11, wherein said relief valve means includes spring means acting with said fluid in said other chamber to bias said valve element means in the closing direction.

13. An overload protection system for a press comprising, piston and cylinder means on said press including a cylinder and a piston in said cylinder providing a pressure chamber therebetween having an outlet, first valve means having a pair of separate fluid receiving chambers and discharge passageway means therefor, said first valve means further including first fluid pressure actuated valve element means for opening and closing said receiving chambers with respect to said discharge passageway means, said first valve element means being operable in response to fluid in each said receiving chambers at a first pressure to close said receiving chambers and being operable in response to fluid in one of said chambers at a second pressure higher than said first pressure to open said receiving chambers, second valve means in flow communication with said pressure chamber outlet, said second valve means including second fluid pressure actuated valve element means normally closing said outlet, said second valve means further including fluid discharge and pressure amplifying passages, and hydraulic fluid supply means including means providing a source of hydraulic fluid and means for delivering hydraulic fluid therefrom under pressure to said receiving chambers and said pressure chamber, said supply means further including means to charge fluid in said receiving chambers to said first pressure and fluid in said pressure chamber to a given pressure no greater than said first pressure, said second valve element means being operable in response to a fluid pressure in said pressure chamber greater than said given pressure to open said pressure chamber outlet to said fluid discharge passage of said second valve means, said means for delivering fluid including flow line means between said one receiving chamber and said pressure amplifying passage of said second valve means, said second valve element means being operable through said amplifying passage and in response to said greater fluid pressure in said pressure chamber to increase the pressure of fluid in said one receiving chamber to said second pressure, and said fluid supply means further including means to prevent the pressure of fluid in the other of said receiving chambers from increasing above said first pressure in response to said greater pressure in said pressure chamber.

14. The overload protection system according to claim 13, wherein said given pressure in said pressure chamber is equal to said first pressure.

15. The overload protection system according to claim 14, wherein said second valve means is multiple stage poppet valve means including means providing restricted continuous flow communication between said one receiving chamber and said pressure chamber.

16. A hydraulic fluid flow system comprising, a hydraulic fluid flow circuit including a source of hydraulic fluid, normally closed relief valve means in said circuit, said valve means including a pair of separate fluid receiving chambers, fluid outlet means for said chambers and reciprocable fluid pressure actuated valve element means, said valve element means being operable in response to fluid in said chambers at the same given pressure to close said chambers with respect to said outlet means and responsive to fluid in one of said chambers at a pressure exceeding said given pressure to open said chambers with respect to said outlet means, said hydraulic circuit including means to deliver fluid from said source to said separate chambers at said given pressure, means in said circuit for increasing the pressure of fluid therein above said given pressure, and said means to deliver fluid to said chambers including means responsive to an increase in pressure in said circuit above said given pressure to prevent flow of fluid at said increased pressure to the other of said chambers, whereby said valve element means opens said chambers to said outlet means and release of fluid in said other chamber to said outlet means accelerates opening of said one chamber and release of said fluid in said circuit at said increased pressure.

17. The fluid flow system according to claim 16, wherein said means to deliver fluid to said one and other chambers at said given pressure includes flow line means between said one and other chambers and receiving fluid at said given pressure from said source, said means to prevent flow to said other chamber including one way valve means in said flow line means open to flow in the direction from said other chamber to said one chamber.

18. The fluid flow system according to claim 16, wherein said relief valve means includes spring means acting with said fluid in said other chamber to bias said valve element means in the closing direction.

19. The fluid flow system according to claim 16, wherein said valve element means includes first and second valve members associated respectively with said one and other chambers, each said valve members having pressure receiving face means in the corresponding chamber, the face means of said second valve member having an effective area greater than that of the face means of said first valve member.

20. The fluid flow system according to claim 16, wherein said valve means includes means cooperable with said valve element means to provide for said other chamber to open before said one chamber opens.

21. The fluid flow system according to claim 16, wherein said valve element means includes first and second valve members interconnected for movement in unison and associated respectively with said one and other chambers, said chambers including means defining valve seat means for the corresponding valve member, said fluid outlet means of said one chamber being a circular opening defining the valve seat means for said first valve member, said first valve member being a cylindrical head and having mating sliding engagement with said circular opening when said one chamber is closed, said first valve member moving axially of said circular opening a given distance to open said first chamber, said second valve member engaging the seat means for said other chamber to close said other chamber and disengaging the last named seat means to open said other chamber, said disengagement occuring before said first valve member moves said given distance.

22. The fluid flow system according to claim 21, wherein said outlet means of said other chamber includes an annular valve seat coaxial with said circular opening and said second valve member transversely engages said annular seat.

23. The fluid flow system according to claim 22, wherein each said first and second valve members has pressure receiving face means in the corresponding chamber when said chambers are closed, the face means of said second valve member having an effective area greater than that of the face means of said first valve member.

24. The fluid flow system according to claim 23, wherein said relief valve means includes spring means acting with said fluid in said other chamber to bias said valve element means in the closing direction.

25. The fluid flow system according to claim 21, wherein said outlet means of said other chamber includes an annular seat surface defining the valve seat means of said second valve member, said second valve member being circular and axially engaging said annular seat surface when said other chamber is closed.

26. The fluid flow system according to claim 25, wherein each said first and second valve members has pressure receiving face means in the corresponding chamber when said chambers are closed, the face means of said second valve member having an effective area greater than that of the face means of said first valve member.

27. The fluid flow system according to claim 26, wherein said relief valve means includes spring means acting with said fluid in said other chamber to bias said valve element means in the closing direction.

28. A hydraulic fluid flow system comprising, a hydraulic fluid flow circuit including a source of hydraulic fluid, normally closed relief valve means in said circuit, said valve means including a pair of separate fluid receiving chambers, fluid outlet means for said chambers, and fluid pressure actuated valve element means, said valve element means being operable in response to fluid in said chambers at the same given pressure to close said chambers with respect to said outlet means and responsive to fluid in one of said chambers at a pressure exceeding said given pressure to open said chambers with respect to said outlet means, said hydraulic circuit including means to deliver fluid from said source to said separate chambers at said given pressure, and said means to deliver fluid to said chambers including means responsive to an increase in pressure in said circuit above said given pressure to prevent flow of fluid at said increased pressure to the other of said chambers, whereby said valve element means opens said chambers to said outlet means and release of fluid in said other chamber to said outlet means accelerates opening of said one chamber and release of said fluid in said circuit at said increased pressure.

* * * * *